US012448743B2

(12) United States Patent
Bichler et al.

(10) Patent No.: US 12,448,743 B2
(45) Date of Patent: Oct. 21, 2025

(54) PROTECTIVE STRUCTURE AND METHOD FOR DISSIPATING TENSILE LOAD APPLIED TO A SUPPORT CABLE IN A SUPPORT CABLE ARRANGEMENT OF THE PROTECTIVE STRUCTURE

(71) Applicant: Trumer Schutzbauten Ges.m.b.H, Oberndorf (AT)

(72) Inventors: Ahren Bichler, Sechelt (CA); Matthias Jakob, Vancouver (CA); Gernot Stelzer, Kuchl (AT); Alex Strouth, Golden, CO (US)

(73) Assignee: Trumer Schutzbauten Ges.m.b.H., Munich (DE)

( * ) Notice: Subject to any disclaimer, the term of this patent is extended or adjusted under 35 U.S.C. 154(b) by 212 days.

(21) Appl. No.: 18/254,798

(22) PCT Filed: Nov. 29, 2021

(86) PCT No.: PCT/EP2021/083383
§ 371 (c)(1),
(2) Date: May 26, 2023

(87) PCT Pub. No.: WO2022/112562
PCT Pub. Date: Jun. 2, 2022

(65) Prior Publication Data

US 2024/0026618 A1 Jan. 25, 2024

(30) Foreign Application Priority Data

Nov. 30, 2020 (DE) ..... 102020131687.9

(51) Int. Cl.
*E01F 7/04* (2006.01)

(52) U.S. Cl.
CPC ..... *E01F 7/045* (2013.01)

(58) Field of Classification Search
CPC ..... E01F 7/00; E01F 7/04; E01F 7/045
See application file for complete search history.

(56) References Cited

U.S. PATENT DOCUMENTS 4,397,255 A 8/1983 Taylor
4,776,140 A 10/1988 Wight et al.
(Continued)

FOREIGN PATENT DOCUMENTS

AT 386632 B 9/1988
CA 2360744 A1 * 5/2002 ..... E01F 7/045
(Continued)

OTHER PUBLICATIONS

European Patent Office, International Search Report and Written Opinion of the International Searching Authority in PCT/EP2021/083383, which is a foreign counterpart to this U.S. Application claims priority.

(Continued)

*Primary Examiner* — Frederick L Lagman
(74) *Attorney, Agent, or Firm* — Kolitch Romano Dascenzo Gates LLC

(57) ABSTRACT

The present disclosure relates to a protective structure having a plurality of supports arranged spaced apart from each other; having a trapping device which is guided on the supports via at least one support cable arrangement; and having a ground anchorage for free ends of the at least one support cable arrangement. The ground anchorage is designed as a deadman anchorage.

14 Claims, 7 Drawing Sheets

(56) References Cited

U.S. PATENT DOCUMENTS

| | | | | | |
|---|---|---|---|---|---|
| 6,131,873 | A * | 10/2000 | Blazon | E01F 7/045 | 248/548 |
| 7,458,449 | B2 * | 12/2008 | Sennhauser | E01F 7/04 | 248/74.1 |
| 8,458,986 | B2 | 6/2013 | Reyes et al. | | |
| 11,391,005 | B2 * | 7/2022 | Journeaux | E01F 7/045 | |
| 2008/0006757 | A1 | 1/2008 | Sennhauser | | |
| 2012/0211712 | A1 * | 8/2012 | Stelzer | E01F 7/045 | 256/23 |

FOREIGN PATENT DOCUMENTS

| | | | | | |
|---|---|---|---|---|---|
| CH | 705894 | A2 * | 6/2013 | E01F 7/045 | |
| DE | 2062477 | A | 7/1971 | | |
| DE | 60023442 | T2 * | 7/2006 | E01F 7/045 | |
| DE | 202010010849 | U1 | 12/2010 | | |
| DE | 202013103523 | U1 * | 12/2014 | E01F 7/045 | |
| EP | 484563 | A1 | 5/1992 | | |
| KR | 100659372 | B1 | 12/2006 | | |
| KR | 101049437 | B1 * | 7/2011 | | |
| KR | 102114186 | B1 * | 5/2020 | | |
| WO | WO-2009127076 | A1 * | 10/2009 | E01F 7/045 | |

OTHER PUBLICATIONS

"IEEE Guide to Installation of Foundations for Transmission Line Structures," in IEEE Std 977-2010 (Revision of IEEE Std 977-1991) , vol. No., pp. 1-87, Feb. 15, 2011, doi: 10.1109/IEEESTD.2011.5716533. URL: https://ieeexplore.ieee.org/stamp/stamp.jsp?tp=&arnumber=5716533&isnumber=5716532.

* cited by examiner

PROTECTIVE STRUCTURE AND METHOD FOR DISSIPATING TENSILE LOAD APPLIED TO A SUPPORT CABLE IN A SUPPORT CABLE ARRANGEMENT OF THE PROTECTIVE STRUCTURE

SUMMARY

The present disclosure provides systems, apparatuses, and methods relating to dissipating tensile load applied to a support structure.

In some examples, a protective structure includes having a plurality of supports arranged in a manner spaced apart from and adjacent to each other; having a trapping device which is guided on the supports via at least one support cable arrangement; and having a ground anchorage for free ends of the at least one support cable arrangement, wherein the ground anchorage is designed as a deadman anchorage.

In some examples, a method for dissipating a tensile load applied to a support cable of a support cable arrangement of a protective structure includes the following process steps: connecting a free end of the support cable to a deadman anchor; placing the deadman anchor and the rope portion adjoining the free end in the bottom material of a mounting region of the protective structure, and applying the tensile load to the support cable and pulling the deadman anchor through the soil material.

Features, functions, and advantages may be achieved independently in various embodiments of the present disclosure, or may be combined in yet other embodiments, further details of which can be seen with reference to the following description and drawings.

BRIEF DESCRIPTION OF THE DRAWINGS

Further details, advantages and features of the present disclosure will be apparent from the following description of embodiments while making reference to the drawing, wherein.

DETAILED DESCRIPTION

Figure 1:
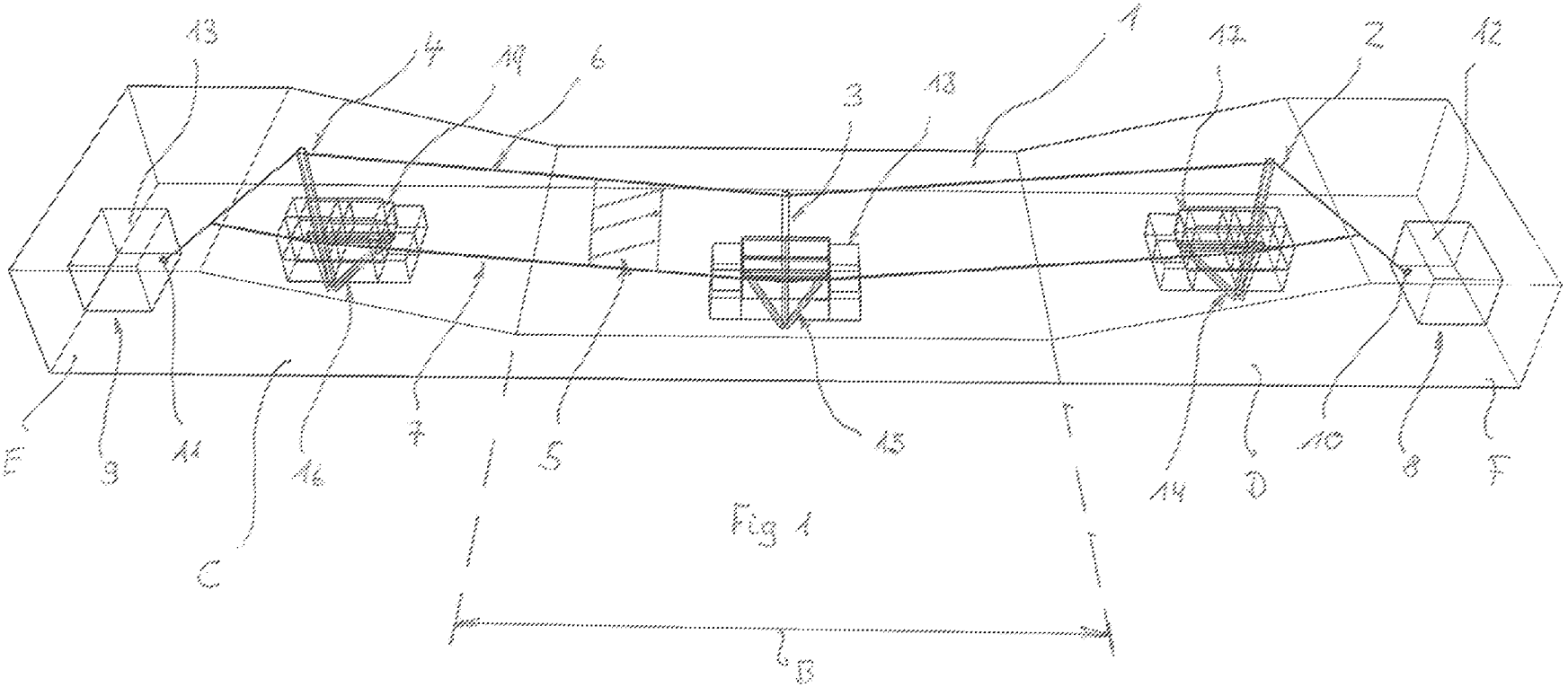
FIG. 1 is a highly schematically simplified perspective top view of a first embodiment of a protective device according to the present disclosure.

The present disclosure relates to a protective structure according to the preamble of claim 1 as well as to a method for dissipating a tensile load applied to a support cable in support cable arrangement of the protective structure according to claim 10.

A generic protective structure is known, for example, from EP-A 484 563 and is to provide protection against rockfall, logging, avalanches, mudslides or the like.

The disadvantage of the generic protective structure resides in that support cables of a support cable arrangement of the protective structures are required to be fixed via ground/rock anchors or posts, which requires drilling into the subsoil for this purpose. Particularly when loose soil material is involved, insertion of such boreholes is extremely costly and requires specific tools, which is especially costly when the protective structure has to be installed in terrain that is difficult to access.

In contrast, it is the object of the present disclosure to provide a protective structure which enables holes to be drilled for ground/rock anchors or posts.

According to the present disclosure, a protective structure is created which is provided with a plurality of supports arranged at a distance from one another, at least two supports being provided.

The protective structure also comprises a trapping device which is guided on the supports via at least one support cable arrangement. The trapping device is usually in the form of a trapping net.

The support cable arrangement comprises a support cable which is guided on the supports via guide elements, such as shackles. At least one such support cable arrangement is provided, but it is also possible that a plurality of such support cable arrangements, such as an upper and a lower support cable arrangement, and one or a plurality of center cable arrangements are provided between the upper and lower support cable arrangements.

The support cable or cables each have free ends that are fixed via a ground anchorage. According to the present disclosure, this ground anchorage is designed as a deadman anchorage, which results in the advantage that it is not required to provide holes in the ground material in order to fix fastening elements, such as ground/rock anchors or posts.

The term "deadman anchorage" refers to a fastening technique for cables that are under tension and are required to withstand large tensile loads, such as the cables of a protective structure when, for example, a boulder hits the trapping device of the protective structure.

To create a deadman anchorage, a narrow pit, for example two to three meters long, is first excavated in the soil material, the depth of which can be adapted to the tensile load to be absorbed and which is referred to as a deadman pit. In the center of this pit, a narrow cable shaft is excavated at a right angle, the bottom of this shaft rising steadily from the bottom of the previously dug deadman's pit to the ground surface at an angle of the cable to be tensioned. After excavation of this pit, the deadman anchor, in particular beam-shaped, is inserted into the deadman pit and the cable mounted thereon is inserted into the cable shaft and guided therefrom to the soil surface, from where the cable is guided over the supports of the protective structure, the deadman pit and the cable shaft being previously refilled with material.

In some examples, it is possible for a plurality of interconnected deadman anchors to be provided to create a deadman anchorage that can withstand very large tensile loads.

For this purpose, the deadman anchors can be spade-shaped, cube-shaped, beam-shaped with a transverse extension, cone-shaped or plow-shaped. In cube-shaped formations, the cube walls can be either lattice or full-surface or partially lattice and partially full-surface. Furthermore, it is possible to fill such cube-shaped deadman anchors with additional suitable material.

Furthermore, in another particularly preferred embodiment, the deadman anchor is placed in a buriable tube that can be filled with material. The filling material can be adapted to the specific application. The arrangement consisting of the tube and the deadman anchor arranged therein will subsequently be buried, which results in the advantage that defined conditions for the mode of action of the deadman anchorage are ensured over predeterminable periods of time.

In another preferred embodiment, it is possible to bury the base arrangements of the supports into the soil material of an assembly site up to a certain height of the lower support section adjoining the base arrangements, whereby preferably these regions of the support can be provided with an erosion protection device surrounding the base arrangements and the adjoining buried support region.

Such erosion protection devices may be a specific erosion resistant material surrounding the base arrangements and the lower support region. Alternatively, arrangements of net or gabion structures may be provided. A gabion is understood to be a wire basket filled with material, in particular stones, and is also referred to as a stone basket, bulk basket, masonry stone basket or wire gravel box.

The present disclosure further relates to a method for dissipating a tensile load applied to a support cable of a support cable arrangement of a protective structure. The method according to the present disclosure comprises the following process steps:

Connecting a free end of the support cable to a dead man's anchor and subsequently burying the dead man's anchor and the cable section adjoining the free end into the soil material of the mounting region of the protective structure.

If a tensile load is applied to the support cable, for example when a boulder impinges onto the trapping net, the advantage of the method results that the support cable pulls the deadman anchor through surrounding soil material, similar to a plow (without the deadman anchor being pulled out of the soil material), whereby the applied tensile load can be absorbed, so that, in this case, the deadman anchorage simultaneously acts as a tensile load dissipation device.

Figure 2:
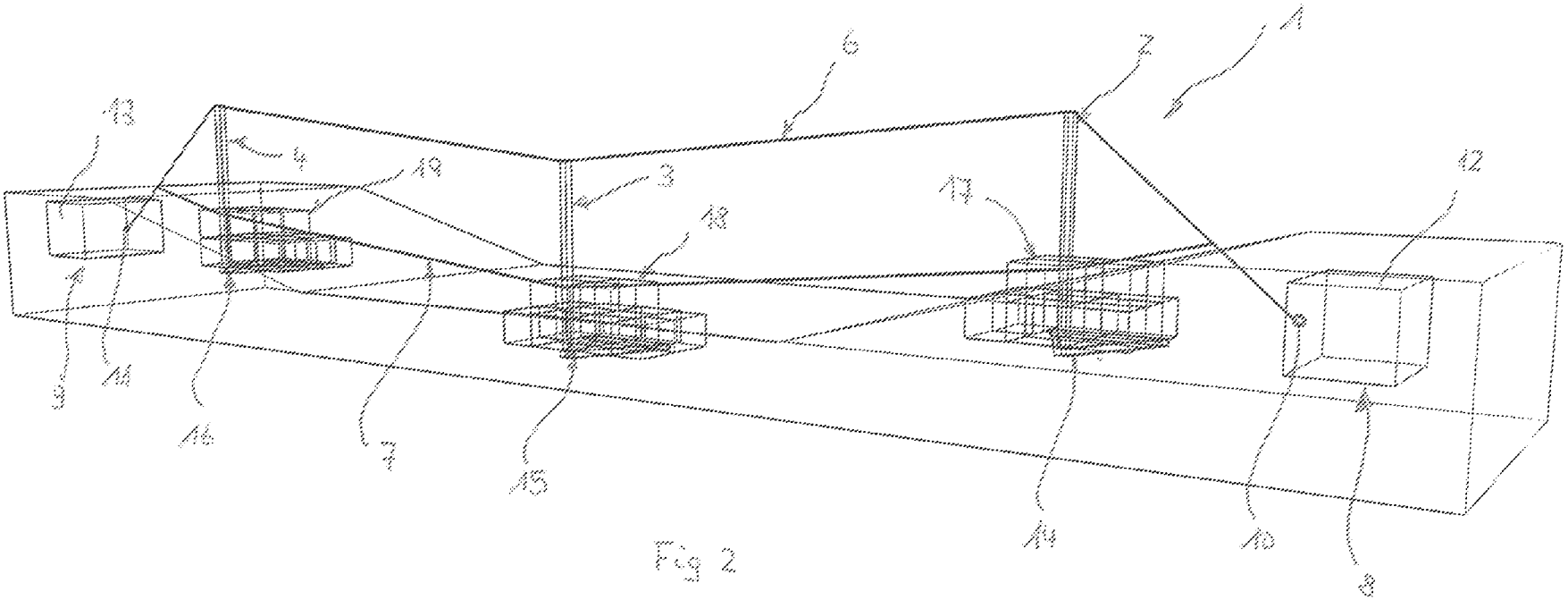
FIG. 2 is a representation of a lateral view of the protective device corresponding to FIG. 1.
Figure 3:
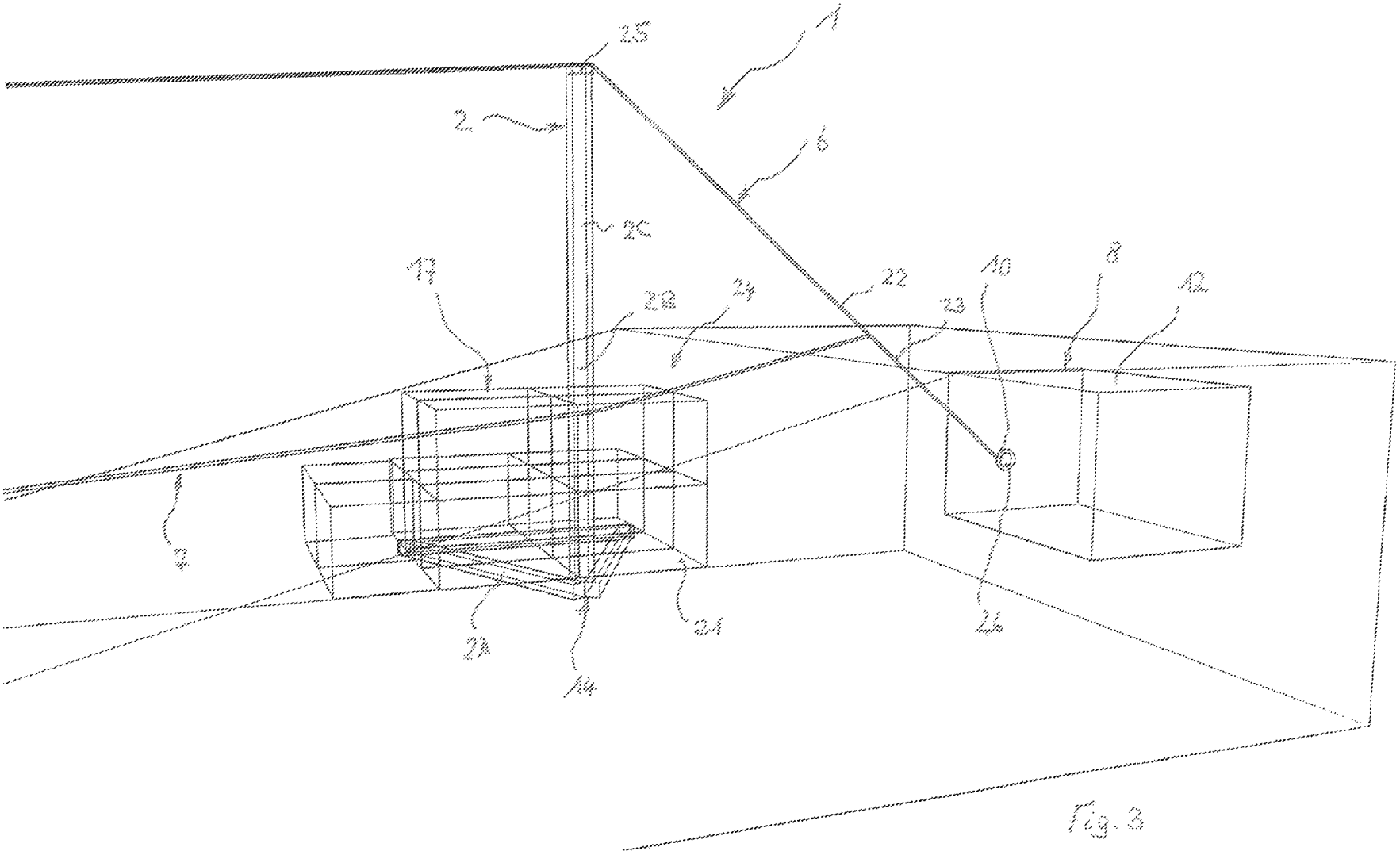
FIG. 3 is an enlarged representation of the right region of the protective device according to FIGS. 1 and 2, and FIGS. 4 to 7 are schematic highly simplified lateral views of different embodiments of deadman anchors of a deadman anchorage according to the present disclosure.

A synopsis of FIGS. 1 to 3 shows the structure of an embodiment of a protective structure 1 according to the present disclosure. In this example, this protective structure 1 has a plurality of supports 2, 3 and 4 arranged spaced apart from each other, the selected number of three supports being purely exemplary. The protective structure 1 further comprises a trapping device represented by a hatched section 5 between two support cable arrangements 6 and 7. This trapping device 5 can be, for example, a trapping net that can completely span a region indicated by the double arrow B in FIG. 1, which can be, for example, a riverbed, laterally adjoined by two inclined regions C and D that merge into end regions E and F. Again, this is merely an optional example of the location of use of the protective structure 1 according to the present disclosure, which may also be used, for example, on mountain inclines as a protection against rockfall and the like.

In the example shown, the trapping device 5 is guided by two support cable arrangements 6 and 7 on the supports 2, 3 and 4. In the simplest case, it is possible that only one support cable arrangement is provided, but it is also possible that one or more center cable arrangements are provided between the support cable arrangements 6 and 7 shown in FIGS. 1 to 3, for example.

Furthermore, the protective structure 1 shown in FIGS. 1 and 2 has two ground anchorages 8 and 9 in the regions F and E, respectively. According to the present disclosure, these ground anchorages 8 and 9 are designed as deadman anchorages, each having a deadman anchor 12 and 13, respectively.

In the embodiment shown, the cable arrangement 6 is connected via the free ends 10 and 11 thereof to a deadman anchor 12 and 13, respectively, of the deadman anchorages 8 and 9. It would be conceivable to also directly connect the free ends of the second support cable arrangement 7 to the deadman anchor, but in the embodiment shown, the free ends of the support cable arrangement 7 are connected to the corresponding adjacent regions of the support cable arrangement 6.

As further illustrated in FIGS. 1 to 3, the supports 2, 3 and 4 each have a buriable base arrangement 14, 15 and 16, respectively. In the example case, each of these base arrangements 14, 15 and 16 is provided with an erosion protection device 17, 18 and 19, respectively.

Representative of all the base arrangements, FIG. 3 shows the base arrangement 14 of the support 2 in enlarged form. It will be apparent therefrom that the base arrangement 14 has a triangular base 2A to which extends, starting from a corner point, a support region 2B which, together with the base 2A, is buried in the soil material of the mounting location 24 on which the support 2 is erected. Accordingly, only the support region 2C of the support 2 is the region that extends beyond the material of the mounting location 24.

It is further apparent from FIG. 3 that the support cable arrangement 6 comprises a support cable 22 having an end portion 23 terminating in the free end 10 and which is also buried in the ground material of the mounting site 24. Furthermore, the support cable arrangement 6 comprises a support cable guide 25, which is identified in FIG. 3 in a highly simplified manner as the upper region of the support section 2C. The support cable guide 25 may, for example, be a shackle. Appropriate support cable guides are provided on the supports 3 and 4.

The free end 10 is mounted on the deadman anchor 12 of the deadman anchorage 8 via a fastening element 26, which, in FIG. 3, is referred to in a highly simplified manner as a double circle.

Finally, FIG. 3 illustrates that the base arrangement 14 is provided with an erosion protection device 17 surrounding the base arrangement and a portion of the support section 2B. As initially explained, the erosion protection device 17 may be any suitable material piled around the base arrangement, or it may be net arrangements or gabion arrangements. This is also symbolized in a highly simplified manner in FIG. 3 by a plurality of cuboids arranged around the base arrangement 14.

Figure 4:
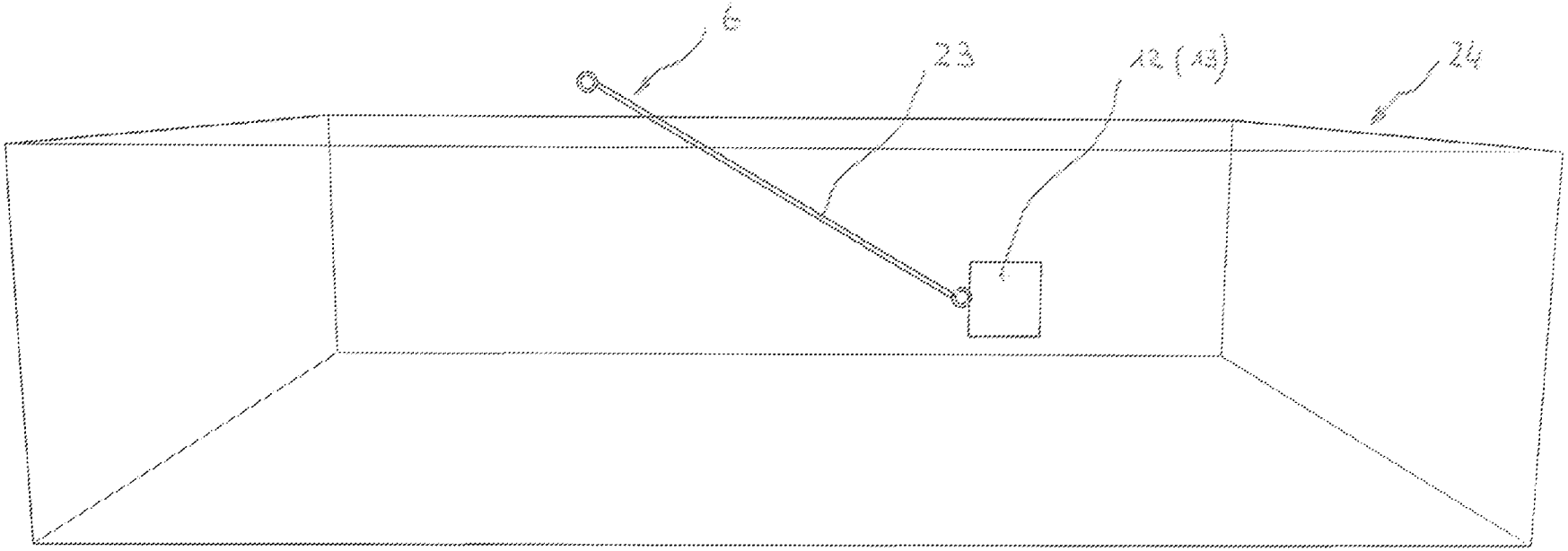
Figure 5:
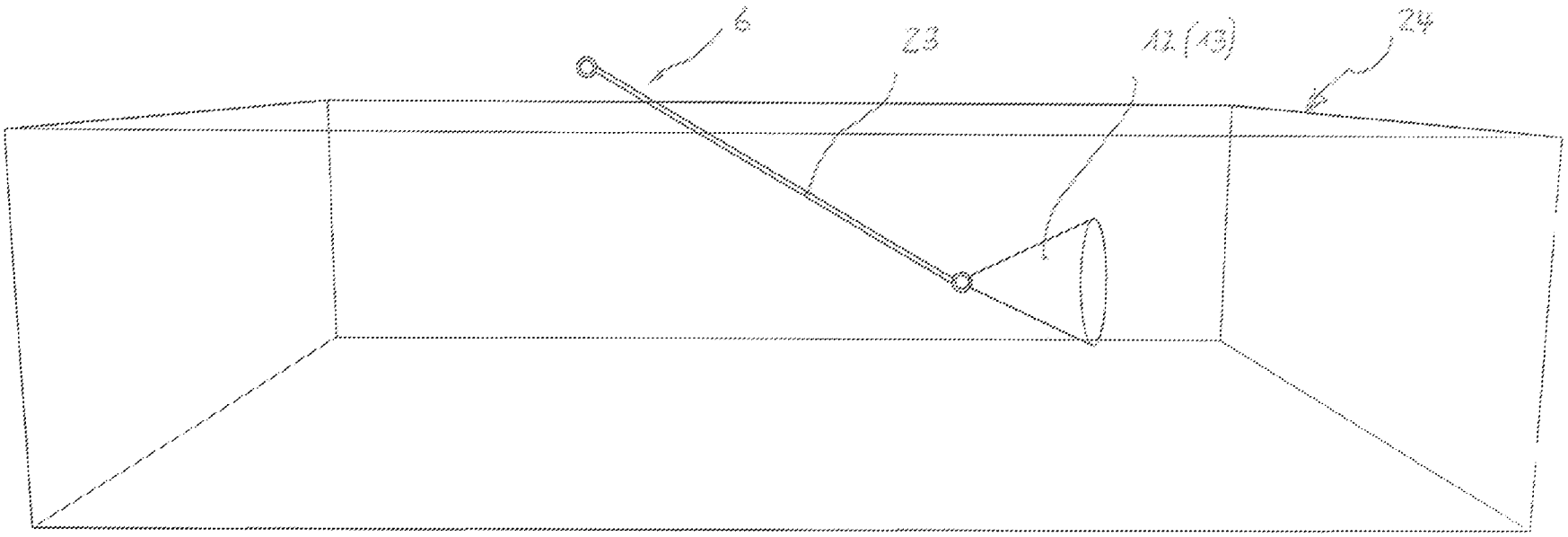

Different embodiments of the deadman anchor 12 or 13 arise from FIGS. 4 to 5. In FIG. 4, as in FIGS. 1 to 3, the deadman anchor 12 or 13 has a cube shape, which can either be a compact component or is designed in the manner of a container, which can be filled with suitable material before the deadman anchor 12 or 13 is buried in the subsoil.

In the embodiment according to FIG. 5, the deadman anchor 12 or 13 is a conical component.

Figure 6:
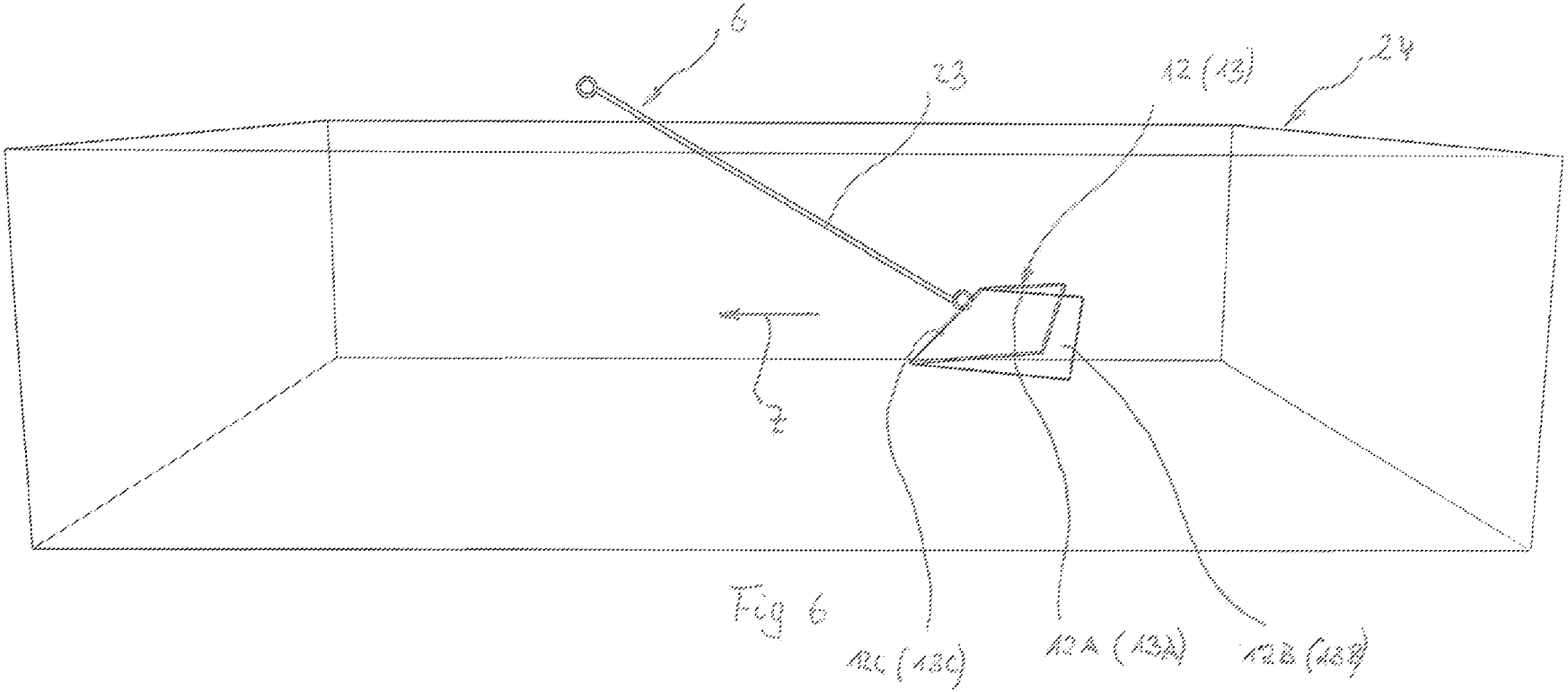

FIG. 6 illustrates an embodiment in which the deadman anchor 12 or 13 is of plow-like design and, in the exemplary embodiment, comprises two plow disks 12A or 13A and 12B or 13B, respectively, arranged at an angle to each other and converging in a sharp edge 12C or 13C, respectively, which points in a pulling direction Z if the deadman anchor 12 or 13, respectively, as defined in the method according to the present disclosure, is pulled through the surrounding material when a tensile load is applied to the cable arrangement 6.

According to the present disclosure, such pulling-through is also possible in the other embodiments according to FIG. 4 or 5.

Figure 7:
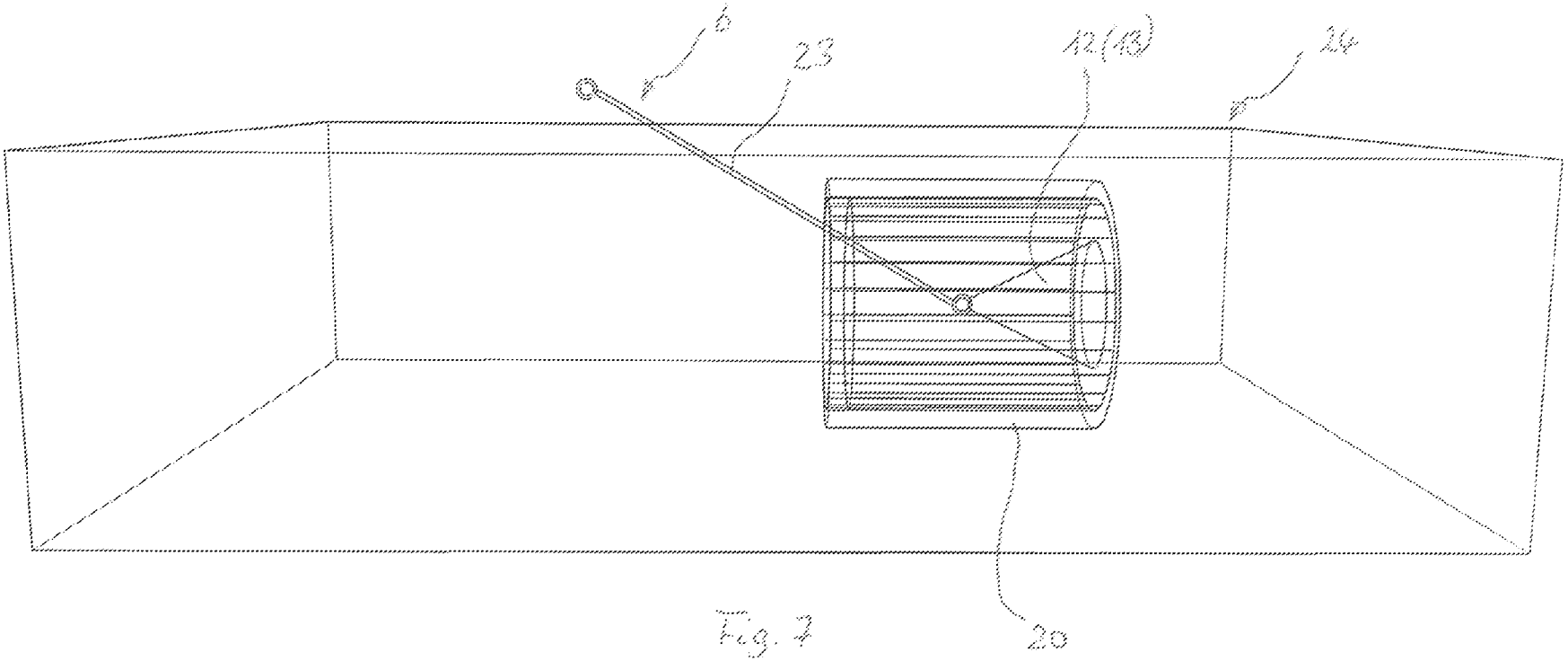

FIG. 7 illustrates an arrangement of the herein cone-shaped deadman anchor 12 or 13 in a tube 20, which, following insertion of the deadman anchor 12 or 13, can be filled with a suitable material adapted to the respective application and then, as is typical for deadman anchorages, is buried at the mounting site 24. As initially explained, this results in the specific advantage that by inserting the deadman anchor 12 or 13 into the pipe 20 and filling it with a suitable material, defined conditions for actuating the deadman anchorage can be set for predeterminable periods of time. In addition to conical deadman anchors, any other design of deadman anchor is also suitable for being applied in the pipe 20.

Furthermore, it is possible to insert a deadman anchor in a hole of a rock and, after the deadman anchor has been placed in the hole of the rock, filling it with a suitable material, which results in the advantage of being able to use an already existing cavity of a rock instead of the pipe 20 as previously described.

Among further advantages, it should particularly be noted that the protective structure 1 according to the present disclosure does not require any extra equipment and tools to be transported to the installation site for installation thereof. Rather, all installation steps can be carried out with equipment, machines and vehicles already present at the installation site of the protective structure 1, which considerably simplifies and reduces installation costs.

In addition to the foregoing written description of the present disclosure, explicit reference herewith is made to the graphic representation of the present disclosure in FIGS. 1 to 7 for additional disclosure thereof.

LIST OF REFERENCE NUMBERS

1 Protective structure
2, 3, 4 Supports
2A Base
2B, 2C Support regions
5 Trapping device
6, 7 Support cable arrangement
8, 9 Ground anchorage
10, 11 Free ends
12, 13 Deadman anchor
14, 15, 16 Base arrangements
17, 18, 19 Erosion protection devices
20 Pipe
21 Gabion structure
22 Support cable
23 Cable region
24 Installation region
Cable guide
26 Fastening element
Z Tension direction

The invention claimed is:

1. A protective structure, comprising:
a plurality of supports arranged in a manner spaced apart from and adjacent to each other;
a trapping device guided on the supports via at least one support cable arrangement; and
a ground anchorage for free ends of the at least one support cable arrangement;
wherein the ground anchorage is configured to operate as a deadman anchorage; and
wherein the plurality of supports comprises buriable base arrangements each surrounded by an erosion protection device.

2. The protective structure according to claim 1, wherein the deadman anchorage has a deadman anchor.

3. The protective structure according to claim 2, wherein the deadman anchor(s), respectively, are formed in a cube-shaped, cone-shaped or plow-shaped manner.

4. The protective structure according to claim 2, wherein the deadman anchor is configured to be pulled through the surrounding soil material by the support cable arrangement.

5. The protective structure according to claim 2, wherein the deadman anchor is placeable in a buriable and fillable tube.

6. The protective structure according to claim 1, wherein the deadman anchorage has a plurality of deadman anchors connected to each other.

7. The protective structure according to claim 1, wherein the erosion protection device comprises a net or net arrangement.

8. The protective structure according to claim 1, wherein the erosion protection device comprises a gabion structure.

9. A method for dissipating a tensile load applied to a support cable of a support cable arrangement of a protective structure, the method comprising:
arranging a plurality of supports spaced apart from and adjacent to each other;
surrounding buried base arrangements of each of the plurality of supports by an erosion protection device;
guiding a trapping device on the plurality of supports via the support cable arrangement;
connecting a free end of the support cable of the support cable arrangement to a deadman anchor;
placing the deadman anchor and a rope portion adjoining the free end in soil material of a mounting region of the protective structure; and
applying a tensile load to the support cable and pulling the deadman anchor through the soil material.

10. The method according to claim 9, wherein the deadman anchor remains in the soil material when being pulled therethrough.

11. The method according to claim 9, wherein performance of the deadman anchor is adjustable by selecting a shape of the deadman anchor.

12. The method according to claim 9, wherein performance of the deadman anchorage is adjustable by selecting a material surrounding the deadman anchorage.

13. The method of claim 9, wherein surrounding the buried base arrangements of each of the plurality of supports by the erosion protection devices comprises surrounding the buried base arrangements of at least one of the plurality of supports by a net or net arrangement.

14. The method of claim 9, wherein surrounding the buried base arrangements of each of the plurality of supports by the erosion protection devices comprises surrounding the buried base arrangements of at least one of the plurality of supports by a gabion structure.

* * * * *